US006507151B1

(12) United States Patent
Kraus et al.

(10) Patent No.: US 6,507,151 B1
(45) Date of Patent: Jan. 14, 2003

(54) GAS DISCHARGE LAMP WITH A CAPACTIVE EXCITATION STRUCTURE

(75) Inventors: Albrecht Kraus, Kerkrade (NL); Bernd Rausenberger, Aachen (DE); Horst Dannert, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 251 days.

(21) Appl. No.: 09/663,597

(22) Filed: Sep. 18, 2000

(30) Foreign Application Priority Data

Sep. 24, 1999 (DE) ..... 199 45 758

(51) Int. Cl.[7] ..... H01J 17/04
(52) U.S. Cl. ..... 313/631; 313/234; 313/607
(58) Field of Search ..... 313/631, 607, 313/625, 635, 634, 594, 234, 25, 42, 47, 621, 608

(56) References Cited

U.S. PATENT DOCUMENTS 2,624,858 A 1/1953 Greenlee ..... 313/201

*Primary Examiner*—Vip Patel
*Assistant Examiner*—Joseph Williams
(74) *Attorney, Agent, or Firm*—Dicran Halajian

(57) ABSTRACT

The invention relates to a gas discharge lamp with a gas discharge vessel filled with a filling gas with a filling gas pressure p and at least one capacitive excitation structure. To improve the luminous efficacy of the gas discharge lamp, it is suggested that an electrode of a dielectric material forms at least one capacitive excitation structure, which electrode is connected to the gas discharge vessel and encloses at least one hollow space with a surface area A and a volume V, for which it is true that $p \cdot V/A < 10$ cmTorr. Such a dielectric or capacitive electrode, according to the invention, is shaped such that it has a hollow space which is closed off in a vacuumtight manner except for a communication to the gas discharge vessel. It has a surface area A on the inside of the electrode and surrounds a volume V. The dimensions of the hollow space are such that $p \cdot V/A < 10$ cmTorr, the filling gas pressure p being given in Torr.

5 Claims, 2 Drawing Sheets

GAS DISCHARGE LAMP WITH A CAPACITIVE EXCITATION STRUCTURE

FIELD OF THE INVENTION

The invention relates to a gas discharge lamp with a gas discharge vessel filled with a filling gas to a filling gas pressure p and at least one capacitive excitation structure.

BACKGROUND OF THE INVENTION

Known gas discharge lamps comprise a vacuumtight vessel with a filling gas having a filling gas pressure p in which the gas discharge takes place, and usually two metal electrodes which are sealed in in the discharge vessel. One electrode supplies the electrons for the discharge, which electrons are returned to the external current circuit through the second electrode. The supply of electrons usually takes place by means of thermionic emission (hot electrodes), but it may alternatively result from emission in a strong electric field or directly owing to ion bombardment (ion-induced secondary emission) (cold electrodes). A gas discharge lamp, however, may also be operated without electrically conducting electrodes. In an inductive mode of operation, the charge carriers are directly generated in the gas volume by an electromagnetic AC field of high frequency (typically above 1 MHz in the case of low-pressure gas discharge lamps). The electrons move in circular paths inside the discharge vessel of such an inductive lamp, and traditional electrodes are absent in this operation. Capacitive excitation structures are used as the electrodes in a capacitive mode of operation. These structures are formed from insulators (dielectrics) which at one side make contact with the gas discharge and at the other side are connected with electrical conduction to an external current circuit (for example by means of a metal contact). When an AC voltage is applied to the capacitive excitation structures, an AC electric field arises in the discharge vessel along whose electric field lines the charge carriers move. Capacitive lamps resemble inductive lamps in high-frequency operation (>10 MHz) because the charge carriers here also are generated through the entire gas volume. The surface properties of the dielectric material of the excitation structures are of minor importance here (so-called $\alpha$-discharge mode). At lower frequencies, the capacitive lamps change their mode of operation, and the electrons important for the discharge must be emitted originally at the surface of the dielectric excitation structure and be multiplied in a so-called cathode drop region so as to maintain the discharge. The emission behavior of the dielectric material is accordingly essential for the operation of the lamp (so-called $\gamma$-discharge mode). In the $\gamma$-discharge mode, a narrow plasma boundary layer is formed adjacent the dielectric surface, resembling the cathode drop region of a DC glow discharge with cold metal cathodes. A voltage drop $U_s$ is present across this boundary layer, which may amount to well over 100 V in dependence on the current density. The corresponding power $U_s \cdot I$ represents a power loss for the light generation, because no light is generated in return for the power dissipated in the boundary layer. I here represents the current through the lamp. A capacitively coupled lamp in the $\gamma$-discharge mode accordingly has a substantially reduced luminous efficacy (lm/W).

Gas discharge lamps require an electronic driver circuit for their operation, which ignites the gas discharge in the lamp and supplies a ballast for lamp operation in an electric circuit. Without a suitable ballast impedance for the lamp in an external electric circuit, the current in the gas discharge lamp would rise owing to an increase in the number of charge carriers in the gas volume of the discharge vessel to such an extent that the lamp would be quickly destroyed.

Such a gas discharge lamps are known from U.S. Pat. No. 2,624,858. A gas discharge lamp with capacitive electrodes is operated by means of a dielectric material with a high dielectric constant $\in$>100 preferably $\in$>2000) at an operating frequency of less than 120 Hz. The external voltage should lie between 500 V and 10,000 V here. A circuit with an electronic driver unit is also necessary for the operation of such a capacitive gas discharge lamp. The power is supplied to the gas discharge lamp through a capacitive coupling through the dielectric material. The dielectric material separates the metal electrode from the gas discharge. The high specific capacitor properties of the dielectric material mean that a charge induced on the metal electrode leads to an ionization and discharge of the filling gas in the lamp. The $\gamma$-discharge mode also leads to the formation of a plasma boundary layer adjacent the dielectric surface in this gas discharge lamp, where a major power loss occurs to the detriment of the luminous efficacy of the lamp.

SUMMARY OF THE INVENTION

It is an object of the invention to provide a gas discharge lamp with a capacitive excitation which has an increased luminous efficacy.

The object is achieved in that an electrode of a dielectric material, which is connected to the gas discharge vessel and which encloses at least a hollow space with a surface area A and a volume V, for which it is true that $p \cdot V/A < 10$ cmTorr, is provided so as to form at least one capacitive excitation structure. In known manner, the gas discharge lamp comprises a discharge vessel which is transparent or transmits the desired radiation, with a usual filling gas (for example a rare gas or a rare gas with mercury in the case of low-pressure gas discharge lamps) at a filling gas pressure p. The discharge vessel comprises at least two spatially separated electrodes or excitation structures of which at least one is constructed as a capacitive excitation structure. The capacitive excitation structure according to the invention may also, for example, be combined with a metal electrode. The capacitive excitation structure is formed by an electrode which consists of a suitable dielectric material such as, for example, a glass, a ceramic material, a polymer, or mixtures thereof, and which is designed for being connected to an external voltage source with an electrically conducting contact. The capacitive excitation structure may alternatively comprise several layers of different dielectric materials. This dielectric or capacitive electrode is shaped such that it has a hollow space. The hollow space is closed in a vacuumtight manner except for a connection to the gas discharge vessel. It has a surface area A on the inside of the electrode and encloses a volume V, which is measured up to the connection point where it is in communication with the gas discharge vessel. According to the invention, the dimensions of the hollow space are such that $p \cdot V/A < 10$ cmTorr, the filling gas pressure p being given in Torr. Obviously, various embodiments of the excitation structure are conceivable within the scope of the invention such as, for example, the use of several electrodes in parallel arrangement which together form one dielectric electrode.

Several processes take place in the hollow space by means of which the ionization of neutral particles necessary for maintaining the discharge is effected more efficiently than in a planar electrode. The electrons perform oscillatory movements in the electric field of the hollow space. This makes the path length in the hollow space greater and the overall ionization level higher than in the plasma boundary layer of a planar cathode. In addition, the ions generated in the negative glow region of the discharge (transitional region between the plasma boundary layer and the positive column with a low electric field but high ionization density) are trapped in the hollow space and return to the cathode again, where they contribute to the secondary emission of electrons. Similarly, other particles which could contribute to the secondary emission, for example UV photons and excited metastable atoms, return to the surface of the cathode again.

These effects have the result that a homogeneous particle balance (charge generated in the plasma boundary layer equals charge drawn from the plasma at the electrode) can be achieved in the plasma boundary layer of an electrode according to the invention with a hollow space at a lower voltage than in the case of a planar electrode. The current-voltage characteristic of a dielectric electrode with a hollow space accordingly shows a considerably flatter gradient than that of a planar electrode, i.e. substantially higher current densities can be achieved with a dielectric electrode with hollow space, given the same voltage, than with a planar electrode. Conversely, given the same current density, the voltages occurring in the plasma boundary layer of a dielectric electrode with a hollow space are lower than for a planar electrode. The power losses are reduced to the same extent, so that the luminous efficacy of the lamp is substantially improved.

In further embodiments of the gas discharge lamp according to the invention, the electrode encloses at least a hollow space with a volume V approximately equal to the volume of a plasma boundary layer which is formed during operation of the gas discharge lamp. If the volume of the hollow space is so dimensioned that it corresponds approximately to the volume occupied by the plasma boundary layer adjacent the dielectric surface, in particular with a maximum deviation of 10%, a particularly high increase in the luminous efficacy of the lamp is achieved.

Since the plasma boundary layer is formed in planar fashion on the inside of the dielectric electrode, a particularly advantageous dimensioning of the hollow space may also be described by means of the diameter D. It is particularly advantageous to provide a hollow space with a diameter D which corresponds approximately to double the thickness of the plasma boundary layer, in particular with a maximum deviation of 10%. In the special case of a cylindrical hollow space, the diameter D of the hollow space corresponds to the diameter of the cylinder. In that case the plasma boundary layer has a thickness equal to the radius of the cylinder.

BRIEF DESCRIPTION OF THE DRAWINGS

Particularly advantageous embodiments of the invention are defined in the dependent claims.

Embodiments of the gas discharge lamp according to the invention will be explained in more detail below with reference to drawings, in which.

DETAILED DESCRIPTION OF THE INVENTION

The embodiments of the gas discharge lamps all utilize a capacitive excitation structure with a dielectric electrode having a hollow space (with a surface area A and a volume V) for which it is true that $p \cdot V/A < 10$ cmTorr (p being the filling gas pressure of the filling gas in the gas discharge vessel). The lamps are operated in the γ-discharge mode, i.e. typically at frequencies below 10 MHz.

Figure 1:
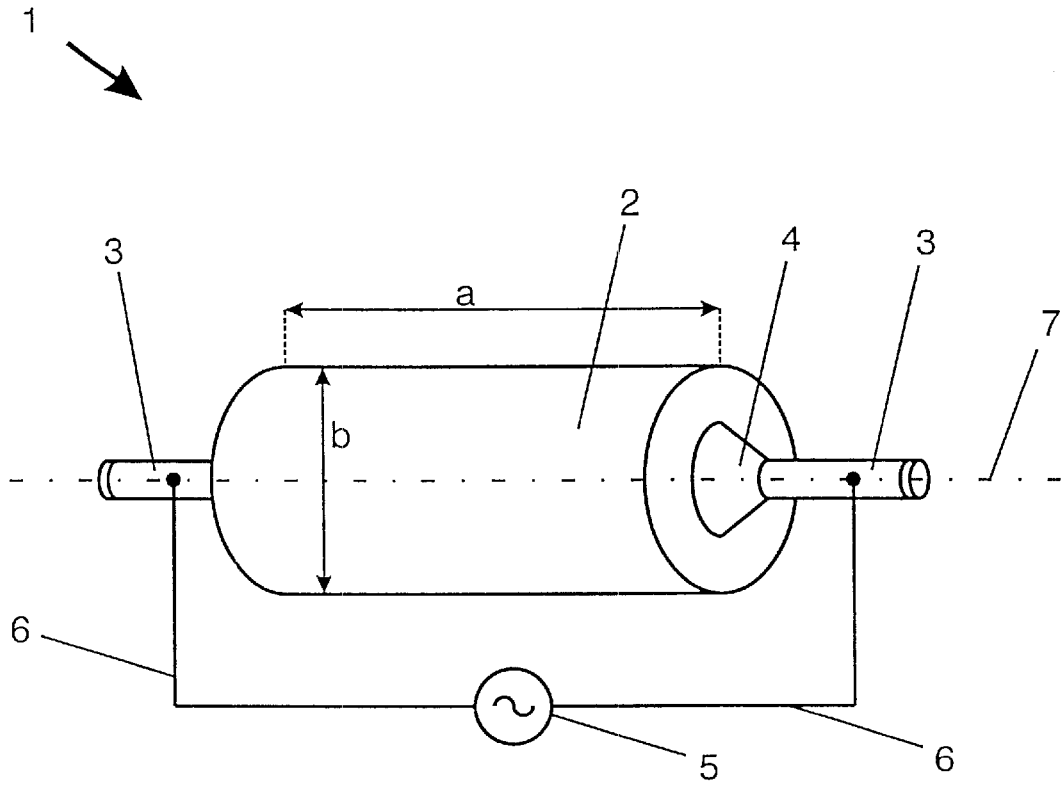
FIG. 1 shows a gas discharge lamp with a cylindrical gas discharge vessel and cylindrical capacitive excitation structures.

FIG. 1 shows a gas discharge lamp 1 with a cylindrical gas discharge vessel 2 and two cylindrical capacitive excitation structures 3. The two capacitive excitation structures 3 are each connected at one end to the gas discharge vessel 2 by means of a vacuumtight joint 4. Furthermore, an RF mains voltage source 5 with supply lines 6 to the capacitive excitation structures 3 is shown. The gas discharge lamp 1 is rotationally symmetrical around an axis 7. The gas discharge vessel 2 comprises a glass tube with a length a=500 mm and an internal diameter b=15 mm. The gas discharge vessel is filled with 5 mbar Ar and 5 mg Hg and is coated with a phosphor on the inside, so that the desired spectrum is radiated. The RF mains voltage source 5 supplies an average voltage of 500 V at a frequency of 5 MHz.

Figure 2:
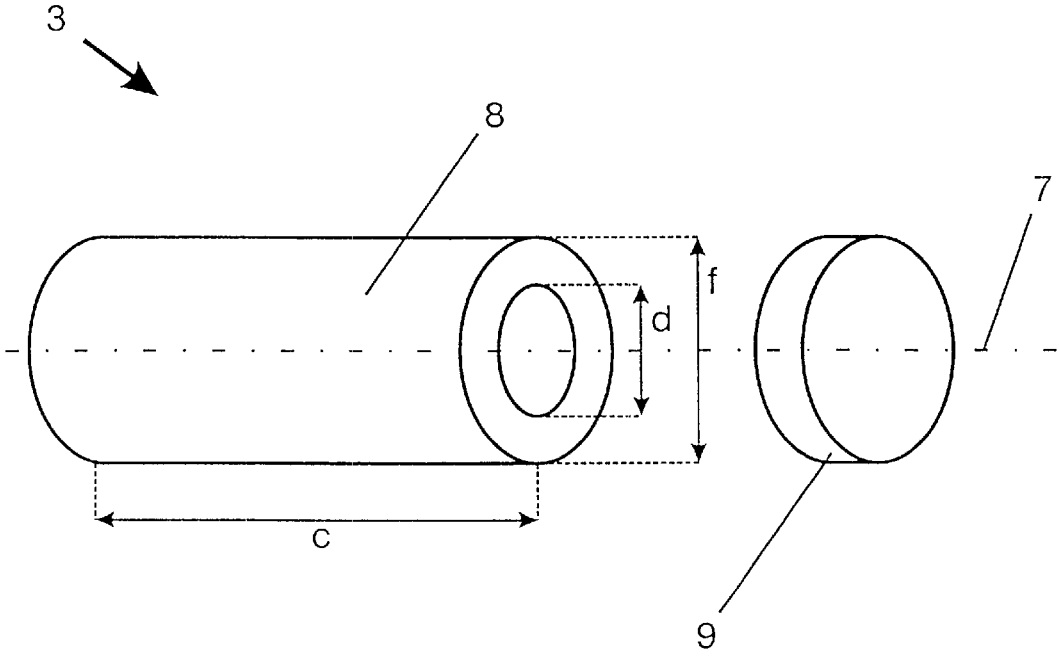
FIG. 2 is a detailed picture of a cylindrical capacitive excitation structure of FIG. 1 with a dielectric electrode.

One of the cylindrical capacitive excitation structures 3 of FIG. 1 is shown in more detail in FIG. 2. It comprises a cylindrical dielectric electrode 8 with a hollow space and a cover 9 which consists of a disc of dielectric material and which closes off the capacitive excitation structure 3 in a vacuumtight manner at one side. The dielectric electrode 8 comprises a glass tube with a length c=20 mm and an external diameter f=2 mm. The hollow space enclosed by the electrode 8 is defined by the internal diameter d=1 mm of the glass tube. A metal layer which is used for contacting the supply lines 6 is provided on the outer circumference of the dielectric electrode 8. The capacitive excitation structure 3 at the same time forms a ballast for the lamp 1, so that an additional external ballast is not necessary. A maximum average current of approximately 40 mA, i.e. an average power of 20 W, is achieved with the lamp 1. The power connected or the operating frequency can be varied through variation in the thickness of the glass tube 8 and thus in the capacitance of the dielectric excitation structure 3, so that an adaptation to any given requirement is possible. The lamp 1 is operated in the γ-discharge mode, so that a plasma boundary layer arises at the electrodes, occupying approximately the hollow space in the glass tube 8. The power losses in the plasma boundary layer are strongly reduced owing to the shape of the dielectric electrodes 8 used, with their hollow spaces.

In a similar embodiment of the lamp 1, a different, non-conducting material than glass is used as the dielectric for the electrode 8. The choice of a suitable material renders it possible to vary the operating parameters of the lamp 1, in particular the operating frequency and the dissipated power, and to adapt them to requirements. For example, operating frequencies in the HF range (around 30 kHz) can be achieved when a dielectric material is used with a dielectric constant $\in \approx 1000$ (for example, $BaTiO_3$, BZT, PLZT) and a thickness of the tubular electrode 8 of 0.5 mm. This renders it possible to operate the lamp 1 on a simplified electronic circuit.

Figure 3:
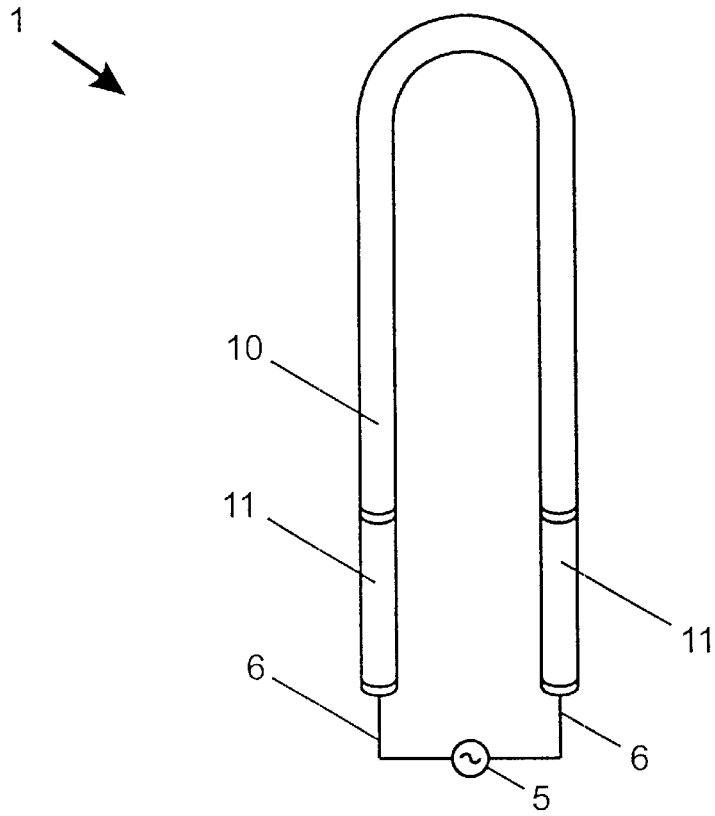
FIG. 3 shows a gas discharge lamp with a curved gas discharge vessel and cylindrical capacitive excitation structures.

FIG. 3 shows a second embodiment of the gas discharge lamp 1 with a curved gas discharge vessel 10 and cylindrical capacitive excitation structures 11. The excitation structures 11 are connected at one side to the gas discharge vessel 10 in a vacuumtight manner and are closed in a vacuumtight manner at the other side. They are connected to the supply lines 6 from a mains voltage source 5 via electrical contacts provided on the outsides of the excitation structures 11. The gas discharge vessel 10 comprises a glass tube bent in a U-shape with an internal diameter of 9 mm which is internally coated with a phosphor and is filled with 5 mbar Ar and 5 mg Hg.

Figure 4:
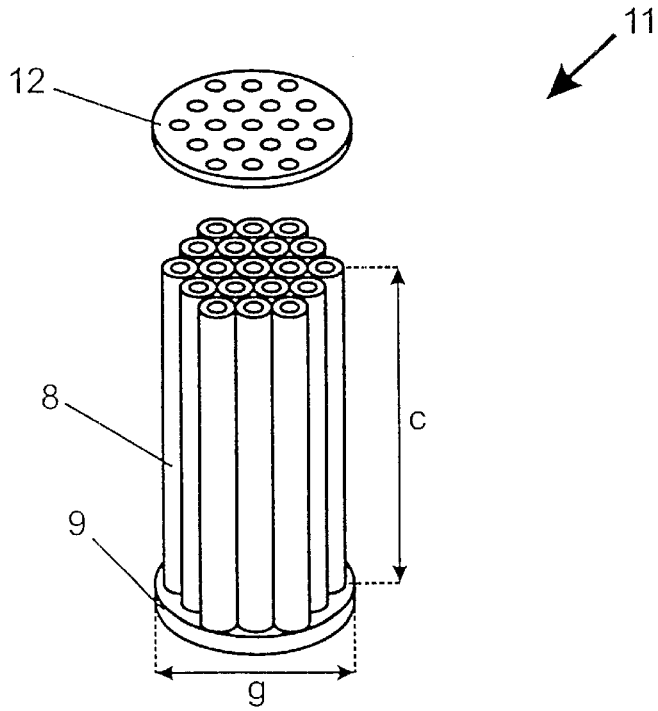
FIG. 4 is a detailed picture of a cylindrical capacitive excitation structure of FIG. 3 with several dielectric electrodes arranged in parallel.

One of the cylindrical capacitive excitation structures 11 of FIG. 3 is shown in more detail in FIG. 4. The capacitive excitation structure 11 comprises several dielectric electrodes 8 arranged in parallel. The tubular electrodes 8 are closed off hermetically at one side by means of a cover 9. The cover 9 is again formed by a disc of a dielectric material. At the other side, a vacuumtight joint is provided between the dielectric electrodes 8 and the gas discharge vessel 10 by means of a glass disk 12. The glass disc 12 has openings so that there is an open communication between the hollow spaces of the electrodes 8 and the gas discharge vessel 10. The capacitive excitation structure 11 has a length c=20 mm and a diameter g=10 mm. The dielectric electrodes 8 arranged in parallel each have an internal diameter d=1 mm and an external diameter f=2 mm combined with a length c=20 mm. The electrodes 8 are made of a dielectric material such as specially doped $BaTiO_3$, and they are all electrically contacted externally by means of a metal layer. Preferably, an excitation structure 11 made of a ferroelectric material with a high saturation polarization P and a highest possible excitation surface A is used for the second embodiment of the lamp 1. The product P·A is the maximum quantity of charge which can be transported per half cycle of the mains voltage source 5. In this embodiment it is possible also upon operation at 230 V and 50 Hz to connect a sufficiently strong current and thus a sufficiently high power (approximately 10 W) to the lamp 1. Such a lamp 1, having the improved luminous efficacy achieved by means of the dielectric electrode 8 according to the invention, can thus be operated directly on a public mains without an expensive electronic driver circuit.

What is claimed is:

1. A gas discharge lamp (1) with a gas discharge vessel (2) filled with a filling gas to a filling gas pressure p and at least one capacitive excitation structure (3), characterized in that at least one electrode (8) of a dielectric material, which is connected to the gas discharge vessel (2) and which encloses at least one hollow space with a surface area A and a volume V, for which it is true that $p \cdot V/A < 10$ cmTorr, is provided so as to form at least one capacitive excitation structure (3).

2. A gas discharge lamp (1) as claimed in claim 1, characterized in that the electrode (8) encloses at least one hollow space with a volume V approximately equal to the volume of a plasma boundary layer which is formed during operation of the gas discharge lamp (1).

3. A gas discharge lamp (1) as claimed in claim 1, characterized in that the electrode (8) encloses at least one hollow space with a diameter D (d) approximately equal to double the thickness of a plasma boundary layer which is formed during operation of the gas discharge lamp (1).

4. A gas discharge lamp (1) as claimed in claim 1, characterized in that at least one glass tube (8) with an internal diameter (d) of approximately 1 mm, an external diameter (f) of approximately 2 mm, and a length (c) of approximately 20 mm is provided so as to form the electrode (8), which tube at one side is connected to the gas discharge vessel (2) in a vacuumtight manner and at the other side is closed off in a vacuumtight manner.

5. A gas discharge lamp (1) as claimed in claim 1, characterized in that at least one tube (8) of a non-conducting, ceramic material with an internal diameter (d) of approximately 1 mm, an external diameter (f) of approximately 2 mm, and a length (c) of approximately 20 mm is provided for forming the electrode (8), which tube at one side is connected to the gas discharge vessel (2) in a vacuumtight manner and at the other side is closed off in a vacuumtight manner.

* * * * *